US007377401B2

(12) United States Patent
Humphrey

(10) Patent No.: US 7,377,401 B2
(45) Date of Patent: May 27, 2008

(54) DISPENSER MECHANISM FOR DISPENSING MULTIPLE PRODUCTS

(75) Inventor: Dallas Humphrey, Long Lake, MN (US)

(73) Assignee: Edina Technical Products, Inc., Plymouth, MN (US)

( * ) Notice: Subject to any disclaimer, the term of this patent is extended or adjusted under 35 U.S.C. 154(b) by 267 days.

(21) Appl. No.: 11/116,954

(22) Filed: Apr. 28, 2005

(65) Prior Publication Data

US 2006/0000847 A1 Jan. 5, 2006

Related U.S. Application Data

(60) Provisional application No. 60/566,215, filed on Apr. 28, 2004.

(51) Int. Cl.
*B65H 3/44* (2006.01)

(52) U.S. Cl. ..... 221/95; 221/252; 221/263; 221/93; 221/133

(58) Field of Classification Search ..... 221/252, 221/263, 265; 222/370
See application file for complete search history.

(56) References Cited

U.S. PATENT DOCUMENTS

| | | | | |
|---|---|---|---|---|
| 3,394,846 | A * | 7/1968 | Carski et al. | 221/93 |
| 3,894,657 | A * | 7/1975 | Echmayr | 221/265 |
| 3,937,314 | A | 2/1976 | Rosenberg et al. | |
| 4,150,766 | A * | 4/1979 | Westendorf et al. | 221/112 |
| 5,549,217 | A * | 8/1996 | Benarrouch | 221/155 |
| 5,667,097 | A * | 9/1997 | Joyce | 221/93 |
| 5,722,656 | A | 3/1998 | Dickerson | |
| 5,988,637 | A | 11/1999 | Dickerson | |
| 6,209,868 | B1 | 4/2001 | Norton | |
| 6,536,623 | B1 | 3/2003 | Sutcliffe | |

* cited by examiner

*Primary Examiner*—Gene O. Crawford
*Assistant Examiner*—Timothy R Waggoner
(74) *Attorney, Agent, or Firm*—Patterson, Thuente, Skaar & Christensen, P.A.

(57) ABSTRACT

The present invention is directed towards improved dispenser mechanisms that can dispense two or more products contained in one or more storage containers. In one embodiment, the dispenser mechanism includes a plate having a first plurality of dispensing apertures positioned a first distance from a central axis of the plate and a second plurality of dispensing apertures positioned a second distance from the central axis of the plate.

16 Claims, 6 Drawing Sheets

DISPENSER MECHANISM FOR DISPENSING MULTIPLE PRODUCTS

CROSS-REFERENCE TO RELATED APPLICATIONS

The current application claims the benefit of priority from U.S. provisional patent application filed on Apr. 28, 2004, entitled "Bulk Dispenser Having Single Actuator and Multiple Dispensing Routes," having Ser. No. 60/566,215, which is incorporated herein by reference.

FIELD OF THE INVENTION

The present invention relates generally to selectively dispensing products such as, for example, prizes, candy, balls and combinations thereof. More particularly, the present invention relates to a dispenser mechanism for selectively dispensing multiple products using a single actuator.

BACKGROUND OF THE INVENTION

There are various types of amusement games in which the player attempts to direct a ball towards various targets. One example of such an amusement game is a pinball machine. Depending on which of the targets are contacted, the player is awarded points with the goal of the pinball game being to accumulate the higher amount of points.

A variation of a typical pinball games involves using an edible product such as a gumball or jawbreaker to play the game. When the game is completed, the product is dispensed to the player. Other related games use rubber balls or prize-containing spheres that are dispensed once the game is completed. More specifically, these types of devices generally dispense the product from a storage container to a playing surface, and after the game is completed, the product is routed from the playing surface to the user. These types of devices are described in, for example, Dickerson, U.S. Pat. Nos. 5,722,656 and 5,988,637, and Norton U.S. Pat. No. 6,209,868, the disclosures of which are all hereby incorporated by reference herein. However, these types of devices cannot dispense two different products, such as, for example, a product to the user and a game piece to a playing surface, using a single actuator.

Gumball dispensing machines have also been known for some time. In response to a person inserting a coin and turning a handle, a rotatable plate inside of the gumball dispensing machine is indexed a selected amount to cause a gumball to be dispensed. Such rotatable plates are disclosed in Rosenberg, et al., U.S. Pat. No. 3,937,314 and Sutcliffe, U.S. Pat. No. 6,536,623, the disclosure of which are both hereby incorporated by reference herein. Again, these plates are not suitable for dispensing multiple types of products from one or more storage regions with a single actuator.

It would be desirable to provide a dispensing mechanism that could address the above-mentioned limitations.

SUMMARY OF THE INVENTION

The present invention is directed towards improved dispenser mechanisms that can dispense two or more products contained in one or more storage containers. In some embodiments, the dispenser mechanism can dispense two products, such as, for example, candy, prizes, balls and the like, to the user, while in other embodiments the dispenser mechanism can dispense one product to the user and a second product to a playing surface. In still further embodiments, the dispenser mechanism can dispense two products to a playing surface. In one embodiment, the dispenser mechanism includes a plate having a first plurality of dispensing apertures positioned a first distance from a central axis of the plate and a second plurality of dispensing apertures positioned a second distance from the central axis of the plate. Due to the presence of the first plurality of dispensing apertures and the second plurality of dispensing apertures, the improved dispenser mechanisms, when combined with appropriate storage containers, can be used to dispense multiple products from separate product storage regions using a single actuator. In another embodiment, two or more dispensing mechanisms can be operably coupled together to facilitate dispensing multiple products. In these embodiments, each dispensing mechanism can include a plate having plurality of dispensing apertures.

The dispensing mechanisms can be designed to dispense two or more products substantially simultaneously or can be designed to dispense different products at different rates. Product dispensing rates can be altered by, for example, adjusting the spacing of the apertures in the dispensing mechanisms, adjusting the size of the dispensing mechanism, adjusting the delivery routes or combinations thereof.

The improved dispenser mechanisms of the present disclosure can be used to dispense, for example, a ball to a playing surface and a prize to a user. Alternatively, the improved dispenser mechanisms can be used to dispense two different prizes to a user. In some embodiments, the plates of the dispenser mechanisms can have a circular configuration, an elliptical configuration or the like, and can include a first plate portion that is spaced apart a fixed distance from a second plate portion. In some embodiments, the first plate portion and/or the second plate portion can include a plurality of indexing apertures proximate an outer edge to facilitate actuation of the dispensing mechanisms. The indexing apertures can be adapted to engage with gear teeth on an actuator such that actuation of the actuator rotates the dispensing mechanism a selected amount.

In a first embodiment, the invention pertains to an apparatus including a container having a first storage region and a second storage region, the first storage region having a first opening and the second storage region having a second opening. The apparatus can further include a dispenser mechanism positioned proximate the first opening and the second opening, the dispenser mechanism including a plate having a first plurality of dispensing apertures positioned a first distance from a central axis and a second plurality of dispensing apertures positioned a second distance from the central axis, wherein at least a portion of the first plurality of dispensing apertures are oriented proximate the first opening and at least a portion of the second plurality of dispensing apertures are oriented proximate the second opening.

In a second embodiment, the invention pertains to a dispensing mechanism for dispensing multiple products, the mechanism including a substantially circular plate having a first plate portion space apart a fixed distance from a second plate portion, wherein the first plate portion includes a plurality of indexing apertures formed in the first plate portion proximate an outer edge of the first plate portion. In these embodiments, the dispensing mechanism can further include a first plurality of dispensing apertures formed into the plate, wherein each of the first plurality of dispensing apertures are positioned a first distance from a central axis of the plate. The dispenser mechanism can also include a second plurality of dispensing apertures positioned a second distance from the central axis. In some embodiments, the second distance from the central axis can be greater than the first distance.

In another embodiment, the invention pertains to an apparatus having a container including a first storage region and a second storage region, the first storage region having a first opening and the second storage region having a second opening. In these embodiments, the apparatus can further include a first dispensing mechanism positioned proximate the first opening, the first dispensing mechanism having a plate with a plurality of first dispensing apertures positioned around a central axis of the first plate. The apparatus can further include a second dispensing mechanism positioned proximate the second opening, the second dispensing mechanism including a second plate having a plurality of second dispensing apertures positioned around a central axis of the second plate, wherein at least a portion of the first plurality of dispensing apertures are oriented proximate the first opening and at least a portion of the second plurality of dispensing apertures are oriented proximate the second opening. In these embodiments, the first dispensing mechanism can be operably coupled to the second dispensing mechanism.

In a further embodiment, the invention pertains to a method of dispensing multiple products, the method including the step of actuating a dispensing mechanism, wherein the dispensing mechanism includes a plate having a first plurality of dispensing apertures positioned a first distance from a central axis and a second plurality of dispensing apertures positioned a second distance form the central axis.

DETAILED DESCRIPTION OF THE INVENTION

Figure 1:
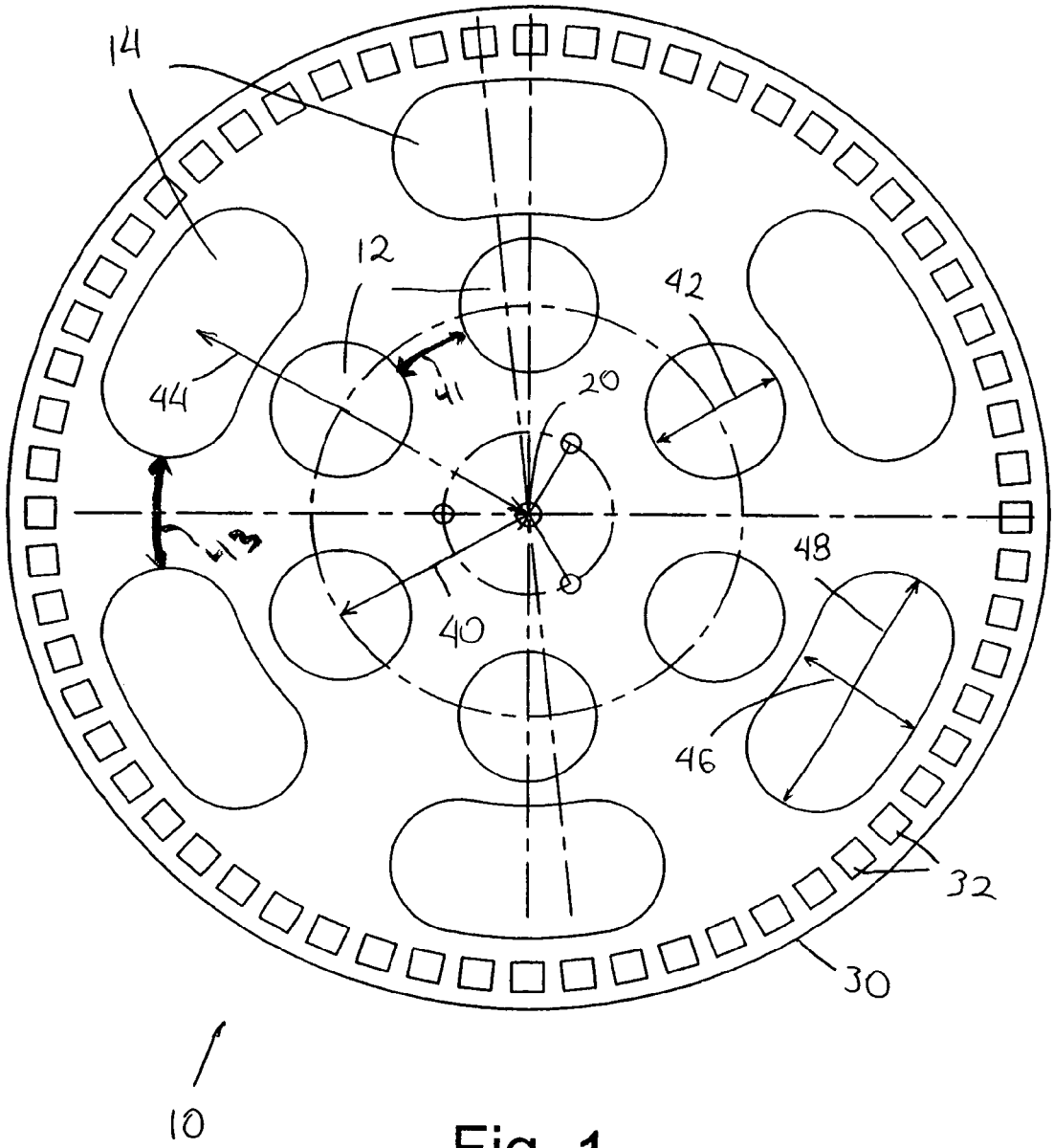
FIG. 1 is a top view of a dispenser mechanism having a first plurality of dispensing apertures positioned a first distance from a central axis and a second plurality of dispensing apertures positioned a second distance from a central axis.
Figure 2:
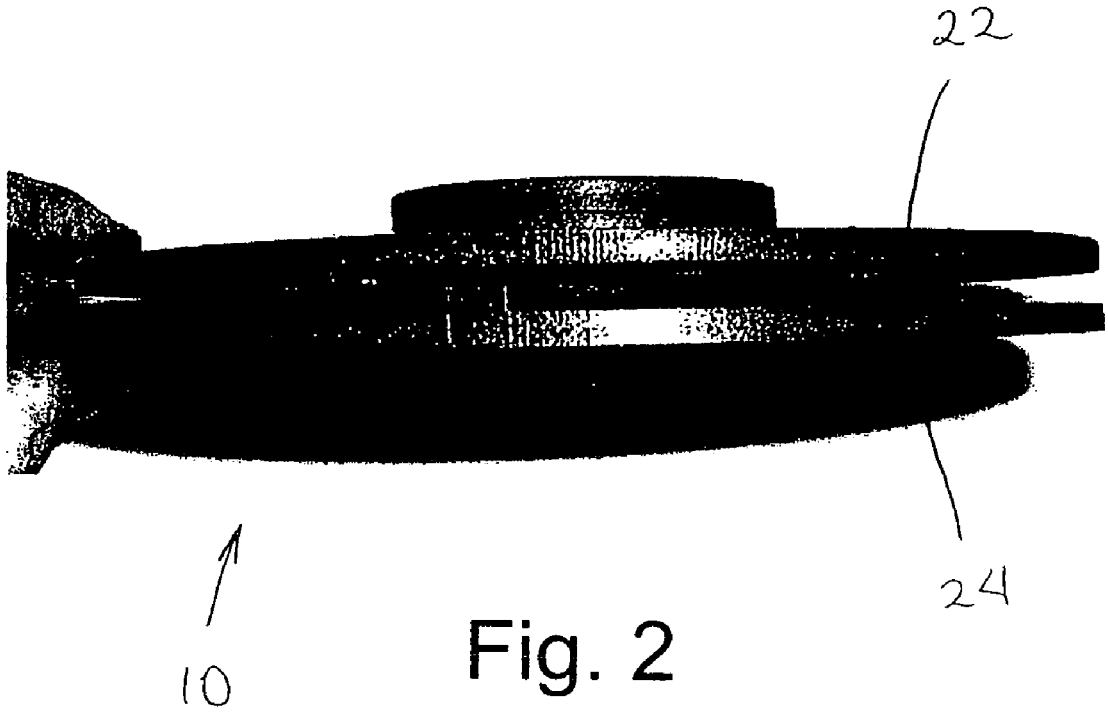
FIG. 2 is a side view of the dispenser mechanism of FIG. 1 depicting a top plate portion spaced apart from a bottom plate portion.

Referring to FIGS. 1 and 2, a dispenser mechanism 10 is depicted including a first plurality of dispensing apertures 12 formed therein and a second plurality of dispensing apertures 14 formed therein. In one embodiment, dispenser mechanism 10 can have a substantially round configuration such that the dispenser mechanism 10 is rotatable about a central axis 20. Dispenser mechanism 10 can include a first plate portion 22 and a second plate portion 24, as depicted in FIG. 2. The first plate portion 22 is preferably spaced a selected distance from the second plate portion 24 such that a distance from a top surface of the first plate portion 22 to a bottom surface of the second plate portion 24 is close to a height of a product that is to be dispensed using the dispenser mechanism 10. In some embodiments, the distance from the top surface of first plate portion 22 to the bottom surface of second plate portion 24 can be from about 0.25 inches to about 3 inches, while in other embodiments the distance from the top surface of first plate portion 22 to the bottom surface of second plate portion 24 can be from about 0.5 inches to about 1.5 inches. One of ordinary skill in the art will recognize that additional ranges of distance between the top surface of the first plate and the bottom surface of the second plate within these explicit ranges are contemplated and are within the scope of the present disclosure.

In some embodiments, a plurality of indexing apertures 32 can be formed into the first plate portion 22 and/or the second plate portion 24 proximate an outer edge 30 of the first plate portion 22 and/or the second plate portion 24. The indexing apertures 32 are adapted to receive teeth on a gear (not depicted in the figures) that are used to rotate the dispensing mechanism 10. One of ordinary skill in the art will recognize that additional mechanisms such as, for example, a belt, chain or a wheel in frictional contact with dispensing mechanism 10 can be used to control the rotation of dispensing mechanism 10.

In one embodiment, each of the first plurality of dispensing apertures 12 is preferably formed a first distance 40 from central axis 20. Spacing 41 between adjacent apertures in the first plurality of dispensing apertures 12 is maybe approximately equal. Each of the apertures in the first plurality of dispensing apertures 12 can be substantially round and can have a diameter 42 that is slightly larger than a diameter of a product that is to be dispensed through the first plurality of dispensing apertures 12. Alternatively, each of the first plurality of dispensing apertures 12 can have other shapes such as, for example, substantially oval, elliptical or rectangular.

The second plurality of dispensing apertures 14 are each preferably formed a second distance 44 from the central axis 20. The second distance 44 is preferably larger than the first distance 40. Spacing 43 between adjacent apertures in the second plurality of dispensing apertures 14 is preferably approximately equal. In one embodiment, each of the apertures in the second plurality of dispensing apertures 14 can be substantially oval and have a width 46 and a length 48 that are larger than a diameter of a product that is to be dispensed through the second plurality of dispensing apertures 14. Alternatively, each of the second plurality of dispensing apertures 14 can have other shapes such as substantially round, elliptical or rectangular. One of ordinary skill in the art will recognize that no particular size and shape dispensing aperture is required by the present disclosure, and that the size and shape of the dispensing apertures employed in a particular dispensing mechanism can be guided by the size and shape of the products being dispensed.

In some embodiment, the length 48 of aperture 14 may be selected to permit simultaneous placement of multiple products in the aperture. For example, each of the apertures in the second plurality of dispensing apertures 14 may be formed with a length that permits 2-6 products to be simultaneously placed in each aperture.

Figure 3:
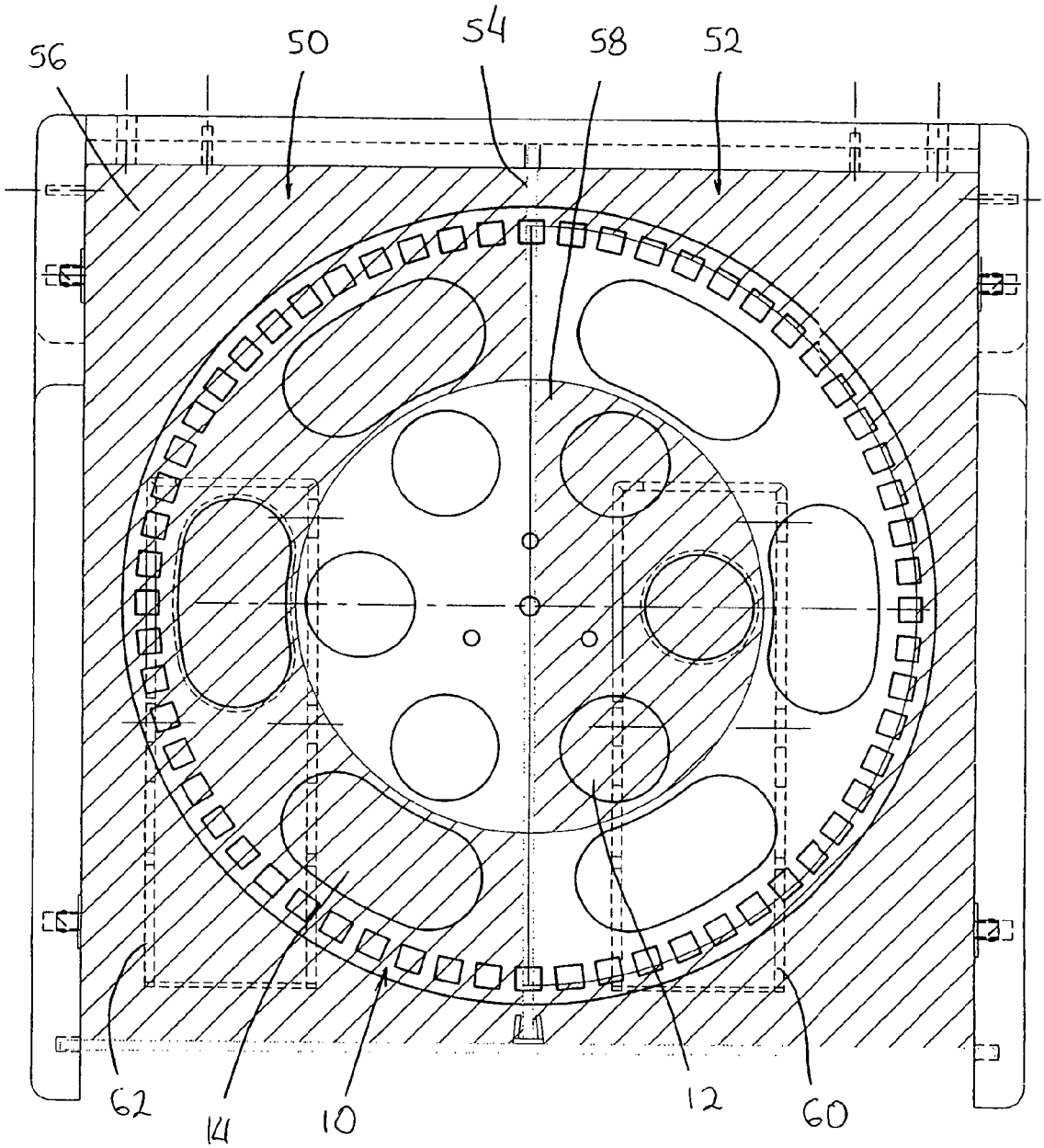
FIG. 3 is a top view of the dispenser mechanism of FIG. 1 positioned in a dispensing apparatus.
Figure 4:
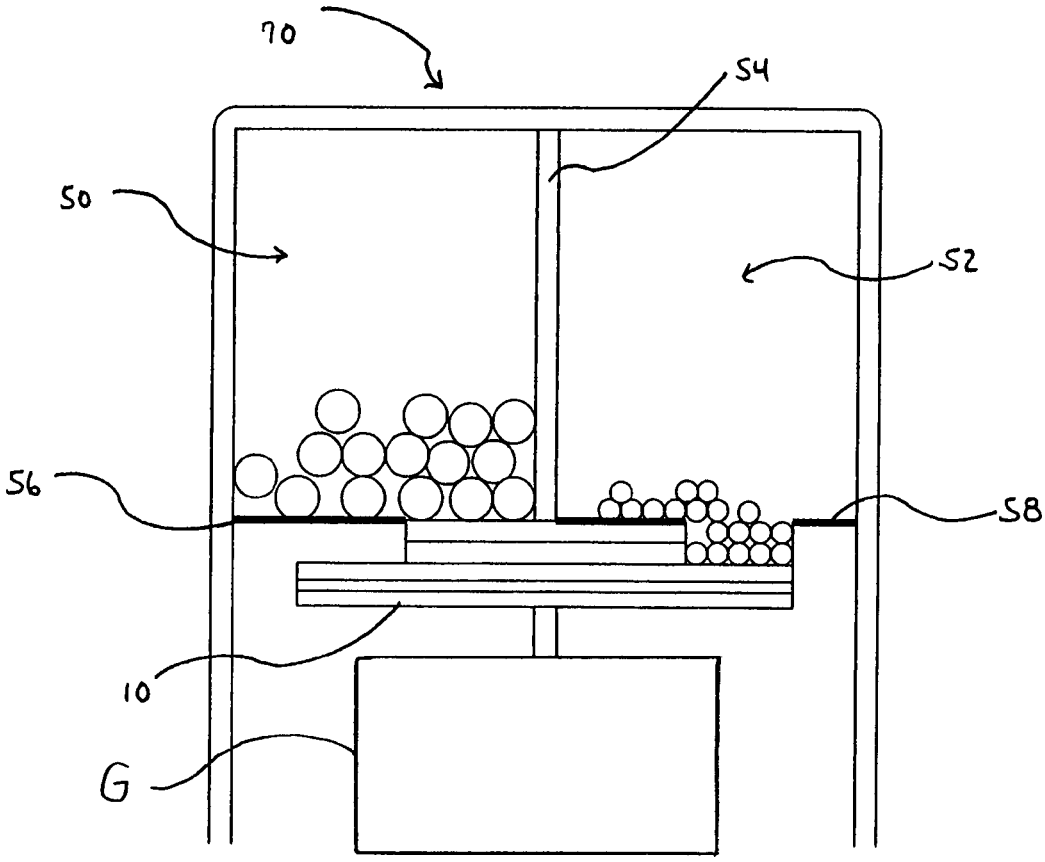
FIG. 4 is a schematic view of a dispensing apparatus that includes an amusement game G.

Referring to FIGS. 3 and 4, dispensing mechanism 10 can be used in conjunction with a hopper, or container, 70 defining at least one product storage region. In one embodiment, the hopper, or container, 70 can define a first product storage region 50 and a second product storage region 52 further defined by divider 54 positioned therebetween.

Divider 54 can be oriented so that approximately half of the dispenser mechanism 10 is in, or proximate, the first product storage region 50, and approximately half of the dispenser mechanism 10 is in, or proximate, the second product storage region 52. The first product storage region 50 and second product storage region 52 are preferably configured to store a number of different products, including but not limited to, gumballs, Lawbreakers, bouncing balls, round and acorn capsules, different types of bulk candy and combinations thereof. The first product storage region 50 can contain a first product and the second storage region 52 can contain a second product that is different from the first product. In some embodiments, each product storage region 50, 52 can contain only one type of product, while in other embodiments each storage region 50, 52 can store a plurality of different products.

The first product storage region 50 can be further defined by first cover 56 that extends over the second plurality of dispensing apertures 14 that are oriented in, or proximate, the first product storage region 50, which can prevent product in the first product storage region 50 from entering the second plurality of dispensing apertures 14. Generally, the first cover 56 does not cover at least one of the apertures in the first plurality of dispensing apertures 12 such that product stored in the first product storage region 50 can enter the aperture when the uncovered aperture is aligned with an opening in the first storage region 50.

Second product storage region 52 can be further defined by second cover 58 that extends over the first plurality of dispensing apertures 12 that are oriented in, or proximate, the second product storage region 52, which can prevent product located in the second product storage region 52 from entering the first plurality of dispensing apertures 12. Generally, the second cover 58 does not cover at least one of the apertures in the second plurality of dispensing apertures dispensing 14 such that product stored in the second product storage region 52 can enter the aperture when the uncovered aperture is aligned with an opening in the second storage region 52.

A first product dispensing channel 60 can extend under at least one of the apertures in the first plurality of dispensing apertures 12. This configuration permits product to be dispensed from the aperture to a user and/or a playing surface when the aperture passes over the first product dispensing channel 60. Additionally, a second product dispensing channel 62 can extend under at least one of the apertures in the second plurality of dispensing apertures 14, which enables product to be dispensed from an aperture to a user and/or playing surface when the aperture passes over the second product dispensing channel 62. Additionally or alternatively, product can also be directed towards dispensing apertures 12 and 14 by one or more chutes, tubes and/or channels operably positioned between the product storage regions and dispensing apertures 12, 14.

Figure 5:
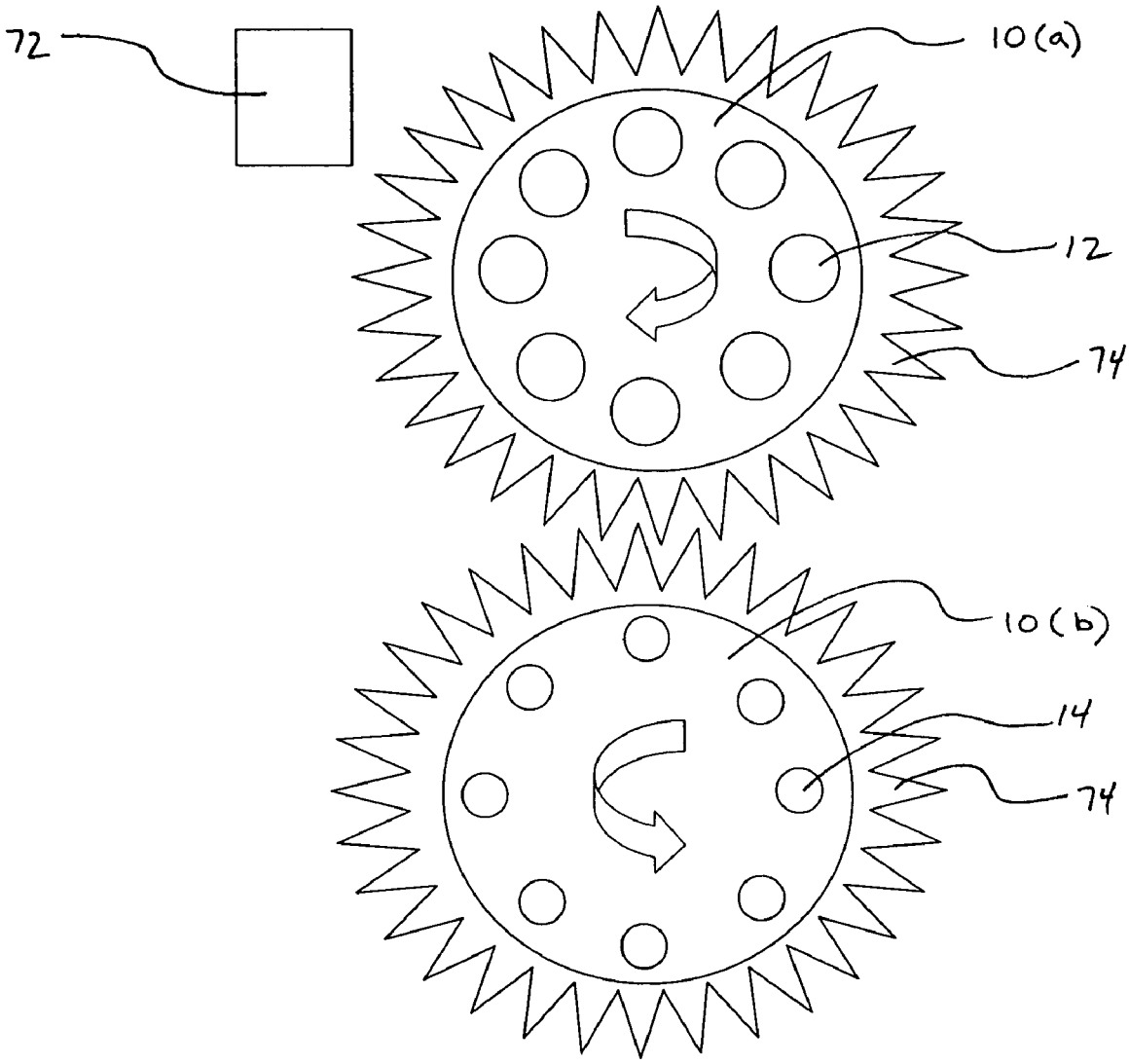
FIG. 5 is a top view of a dispenser mechanism having a first plate operably coupled to a second plate.
Figure 6:
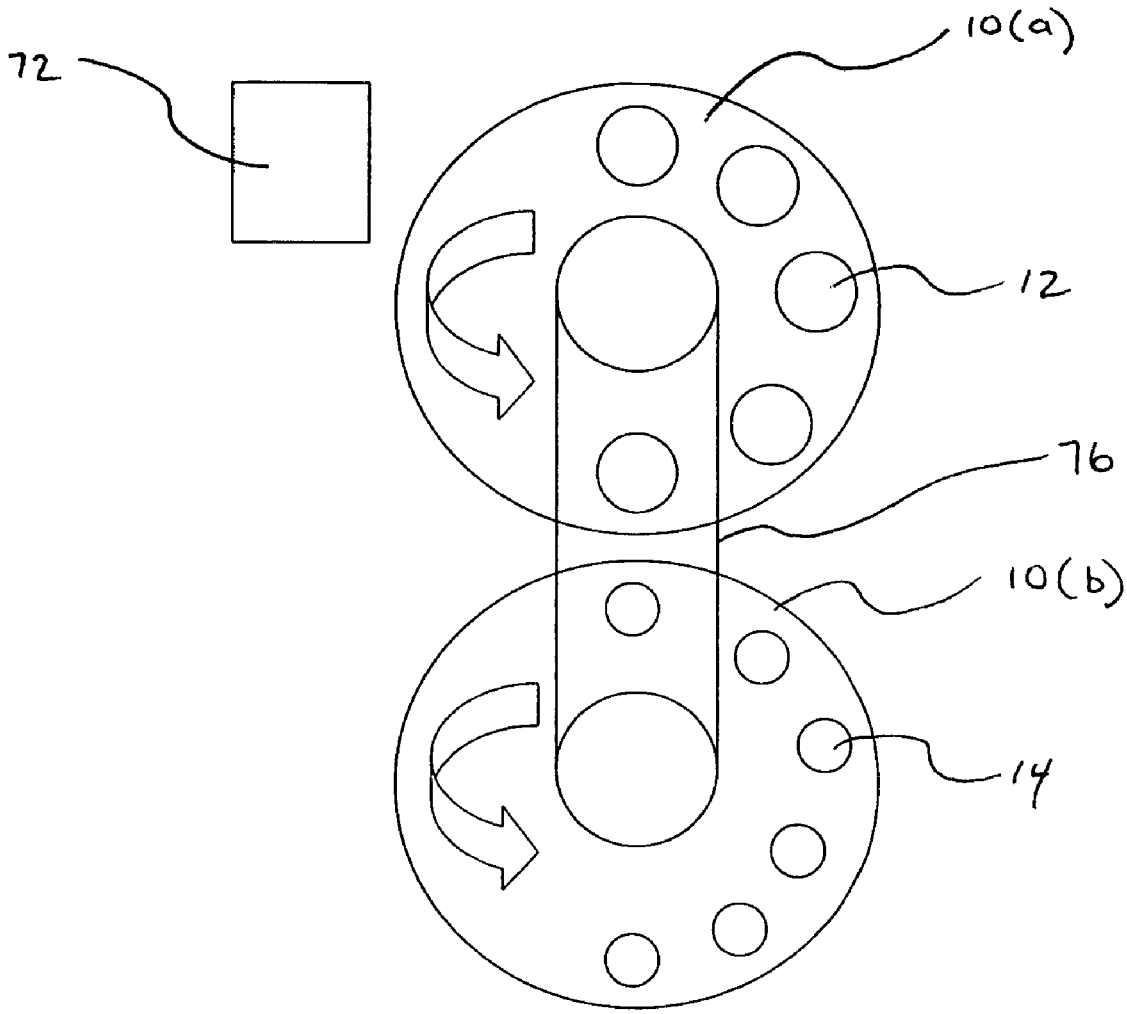
FIG. 6 is a top view of a dispenser mechanism having a first plate operably coupled to a second plate by a belt, wherein the first plate rotates in the same plane as the second plate.

Referring to FIGS. 5 and 6, in other embodiments, the dispensing mechanism can include two or more product dispensing plates. The two or more product dispensing plates are preferably located proximate each other and are preferably operably coupled, for example, by gear teeth 74 (as depicted in FIG. 5) or by a belt or chain 76 (as depicted in FIG. 6). In the embodiments as depicted in FIGS. 5 and 6, a first product dispensing plate 10(*a*) can be located in, or proximate, the first product storage region 50 and a second product dispensing plate 10(*b*) can be located in, or proximate, the second product storage region 52.

A person of ordinary skill in the art will recognize that the concepts of the present invention may be adapted for use with three or more sets of apertures for dispensing three or more products from three or more product storage regions.

In embodiments employing the dispensing mechanism of FIGS. 1 and 2, a person who desires to play, for example, an amusement game places his or her money or token into the receptacle provided on the amusement game. The person then rotates the handle on the amusement game. Rotation of the handle, which is operably coupled to dispensing mechanism 10, thereby causes the dispensing mechanism 10 to be rotated. Rotation of the dispensing mechanism 10 can cause a first product to be dispensed from one of the apertures in the first plurality of dispensing apertures 12 that pass over the first product dispensing channel 60. In one embodiment, the first product is preferably dispensed to the person as a prize for playing the amusement game, however in other embodiments the first product can be a game piece, such as a ball, that is dispensed to a playing surface. In addition, as dispensing mechanism 10 is rotated, the apertures of the first plurality of dispensing apertures 12 that are moved into the first product storage region 50 can be refilled with first product from the first product storage region 50, such that a first product may be dispensed by a subsequent person who plays the amusement game.

Rotation of the dispensing mechanism 10 can also cause a second product to be dispensed from one of the apertures in the second plurality of dispensing apertures 14 that pass over the second product dispensing channel 62. In one embodiment, the second product can be discharged into the amusement game such that the person playing the game is given the opportunity to manipulate the second product in the amusement game. If the person performs certain selected manipulations with the second product, the second product can be dispensed from the amusement game. Otherwise, the second product can be retained in the amusement game. If multiple second products are dispensed, the time associated with playing the amusement game can be extended. Additionally, as dispensing mechanism 10 is rotated, the apertures of the second plurality of dispensing apertures 14 that are moved into the second product storage region 52 can be refilled with second product from the second product storage region 52, such that a second product may be dispensed by a subsequent person who plays the amusement game.

In the embodiment depicted in FIG. 5, a person who desires to play, for example, an amusement game places his or her money or token into a receptacle provided on the amusement game. The person then rotates the handle (not depicted in the figures) on the amusement game. Rotation of the handle, which is operably coupled to first dispensing plate 10(*a*), causes first dispensing plate 10(*a*) to be rotated. As the first dispensing plate 10(*a*) is rotated, the gear teeth 74 on the first product dispensing plate interact with the gear teeth 74 on a second product dispensing plate 10(*b*), causing second product dispensing plate 10(*b*) to rotate in the opposite direction of first product dispensing plate 10(*a*). For example, if the first product dispensing plate 10(*a*) rotates in a clockwise direction, the second product dispensing plate 10(*b*) will rotate in a counter-clockwise direction.

Rotation of the first dispensing plate 10(*a*) can cause a first product to be dispensed from one of the apertures in the first plurality of dispensing apertures 12(*a*) that pass over the first product dispensing channel. First product dispensing channel can be adapted to deliver the first product to the user. Alternatively, first product dispensing channel can be adapted to deliver the first product to a playing surface. Additionally, as first dispensing plate 10(*a*) is rotated, a portion of the first plurality of dispensing apertures 12(*a*) can be moved into operative communication with the first product storage region and can be refilled with first product from the first product storage region, such that a first product may be dispensed by a subsequent person who plays the amusement game.

Rotation of the second dispensing plate 10(*b*) can also cause a second product to be dispensed from one of the apertures in the second plurality of dispensing apertures 14(*a*) that passes over the second product dispensing channel. Second product dispensing channel can be configured to deliver the second product to the user or to a playing surface. As second dispensing plate 10(*b*) is rotated, a portion of the second plurality of dispensing apertures 14(*a*) can be moved into operative communication with the second product storage region and can be refilled with second product from the second product storage region, such that the second product may be dispensed by subsequent persons who play the amusement game.

In the embodiment as depicted in FIG. 6, a person who plays, for example, an amusement game can place his or her money or token into a receptacle provided on the amusement game. The person then rotates the handle (not depicted in the figures) on the amusement game. Rotation of the handle, which is operably coupled to first dispensing plate 10(*a*), causes first dispensing plate 10(*a*) to be rotated. As the first dispensing plate 10(*a*) is rotated, the belt or chain 76 connected to the first product dispensing plate 10(*a*) interacts with the second product dispensing plate 10(*b*), causing the second product dispensing plate 10(*b*) to rotate in same direction as the first product dispensing plate 10(*a*). For example, if the first product dispensing plate 10(*a*) rotates in a clockwise direction, the second product dispensing plate 10(*b*) will also rotate in a clockwise direction.

It will also be appreciated that the dispensing mechanisms of the present disclosure can be configured to allow varying ratios of products to be dispensed from the first product storage region 50 and second product storage region 52 when a handle of a product dispenser is rotated. Such configurable aspects include, for example: the first distance 40 and second distance 44 and the ratio between the first distance 40 and second distance 44; the spacing 41 between each of the apertures in the first plurality of dispensing apertures 12; the spacing 43 between each of the apertures in the second plurality of dispensing apertures 14; the diameter of the first plurality of dispensing apertures 12; the width 46 and length 48 of the second plurality of dispensing apertures 14; the shapes of the first plurality of dispensing apertures 12 and second plurality of dispensing apertures 14; the sizes of the first dispensing plate 10(*a*) and the second dispensing plate 10(*b*); and the gear ratio between the first dispensing plate 10(*a*) and the second dispensing plate 10(*b*). By selecting different configurations of the foregoing aspects, those skilled in the art will appreciate that the ratio of dispensed products from the first product storage region 50 and second product storage region 52, or vice versa, can be 1:1, 1:2, 1:3, 1:4, . . . 1:X, 2:2, 2:4, etc.

As described above, the dispenser mechanisms of the present disclosure preferably have the ability to vend any desired combination of products from a first product storage region 50 and a second product storage region 52 at the same time. In one embodiment, upon rotation of the dispenser mechanism, at least one candy product can be vended directly onto the first product dispensing channel 60 while at least one round product, such as, for example, a ball, can be vended onto the second product dispensing channel 62 and subsequently into a holding area or onto a playfield or playing surface.

The embodiments above are intended to be illustrative and not limiting. Additional embodiments are within the claims. Although the present invention has been described with reference to particular embodiments, workers skilled in the art will recognize that changes may be made in form and detail without departing from the spirit and scope of the invention.

What is claimed is:

1. An apparatus comprising:

a container defining a first storage region for holding of a first product and a second storage region for holding of a second product, the first storage region and the second storage region being separated by a common dividing wall, the container further defining a first opening in communication with the first storage region and a second opening in communication with the second storage region;

a dispenser mechanism positioned proximate the first opening and the second opening, the dispenser mechanism capable of rotating around a central axis comprising a plate having a first plurality of dispensing apertures positioned a first distance from the central axis and a second plurality of dispensing apertures positioned a second distance from the central axis; and wherein at least a portion of the first plurality of dispensing apertures are oriented proximate and in communication with the first opening and at least a portion of the second plurality of dispensing apertures are oriented proximate and in communication with the second opening, and wherein the central axis is located between the first and second storage regions and passes through the common dividing wall.

2. The apparatus of claim 1, wherein the first plurality of dispensing apertures only communicate with the first opening to receive first product from the first storage region.

3. The apparatus of claim 2, further comprising a first product dispensing channel in communication with at least one of the first plurality of dispensing apertures such that product positioned in the first plurality of dispensing apertures is dispensed when each of the first plurality of dispensing apertures are in communication the first product dispensing channel.

4. The apparatus of claim 3, wherein the second plurality of dispensing apertures only communicate with the second opening to receive second product from the second storage region.

5. The apparatus of claim 4, further comprising a second product dispensing channel in communication with at least one of the second plurality of dispensing apertures such that product positioned in the second plurality of dispensing apertures is dispensed when the each of the second plurality of dispensing apertures in communication with the second product dispensing channel.

6. The apparatus of claim 3, wherein each of the first plurality of dispensing apertures has a substantially circular shape.

7. The apparatus of claim 5, wherein each of the second plurality of dispensing apertures has a substantially elliptical shape.

8. The apparatus of claim 1, wherein the dispensing mechanism comprises a top plate portion and a bottom plate portion, wherein the top plate portion is spaced a fixed distance from the bottom plate portion.

9. The apparatus of claim 8, wherein a plurality of indexing apertures are formed in the top plate portion proximate an outer edge of the top plate portion.

10. The apparatus of claim 1, wherein the spacing between adjacent apertures in the first plurality of dispensing apertures is approximately equal.

11. The apparatus of claim 1, wherein the spacing between adjacent apertures in the second plurality of dispensing apertures is approximately equal.

12. The dispenser mechanism of claim 5, further comprising an amusement game and wherein the first product is dispensed to the amusement game.

13. A dispensing mechanism for dispensing multiple products comprising:

a substantially circular plate having a top plate portion spaced apart a fixed distance from a bottom plate portion, wherein the top plate portion comprises a plurality of indexing apertures formed in the top plate portion proximate an outer edge of the top plate portion;

the top plate portion comprising a first plurality of openings positioned a first distance from a central axis and a second plurality openings positioned a second distance from a central axis;

the bottom plate portion comprising a first plurality of openings and a second plurality of openings, wherein the first plurality of openings in the top plate are aligned with the first plurality of openings in the bottom plate to form a first plurality of dispensing apertures, and wherein the second plurality of openings in the top plate are aligned with the second plurality of openings in the bottom plate to form a second plurality of dispensing apertures; and wherein the first and second plurality of dispensing apertures are configured to store one or more products, the products selected from the group consisting of gumballs, jawbreakers, bouncing balls, round and acorn capsules, bulk candy and combinations thereof.

14. The dispensing mechanism of claim 13, wherein each of the first plurality of openings in the top and bottom plate has a substantially circular shape.

15. The dispensing mechanism of claim 14, wherein each of the second plurality of openings in the top and bottom plate has a substantially elliptical shape.

16. A dispensing mechanism for dispensing multiple products comprising:

a substantially circular plate having a top plate portion spaced apart a fixed distance from a bottom plate portion, wherein the top plate portion comprises a plurality of indexing apertures formed in the top plate portion proximate an outer edge of the top plate portion;

the top plate portion comprising a first plurality of openings positioned a first distance from a central axis and a second plurality openings positioned a second distance from a central axis;

the bottom plate portion comprising a first plurality of openings and a second plurality of openings, wherein the first plurality of openings in the top plate are aligned with the first plurality of openings in the bottom plate to form a first plurality of dispensing apertures, and wherein the second plurality of openings in the top plate are aligned with the second plurality of openings in the bottom plate to form a second plurality of dispensing apertures; and wherein the first and second plurality of dispensing apertures are configured to store one or more products.

* * * * *

UNITED STATES PATENT AND TRADEMARK OFFICE

CERTIFICATE OF CORRECTION

PATENT NO. : 7,377,401 B2
APPLICATION NO. : 11/116954
DATED : May 27, 2008
INVENTOR(S) : Dallas Humphrey It is certified that error appears in the above-identified patent and that said Letters Patent is hereby corrected as shown below:

Column 5, line 8:

Delete "Lawbreakers," and insert --jawbreakers,--.*

Signed and Sealed this

Thirtieth Day of September, 2008

JON W. DUDAS
*Director of the United States Patent and Trademark Office*